US008146873B2

(12) United States Patent
Johnson

(10) Patent No.: US 8,146,873 B2
(45) Date of Patent: Apr. 3, 2012

(54) CABINET INSTALLATION ASSEMBLY

(76) Inventor: Paul L. Johnson, Silver Spring, MD (US)

( * ) Notice: Subject to any disclaimer, the term of this patent is extended or adjusted under 35 U.S.C. 154(b) by 438 days.

(21) Appl. No.: 12/420,252

(22) Filed: Apr. 27, 2009

(65) Prior Publication Data

US 2010/0270444 A1 Oct. 28, 2010

(51) Int. Cl.
*A47B 57/04* (2006.01)

(52) U.S. Cl. ..... 248/242; 248/201; 248/274.1

(58) Field of Classification Search ..... 269/79, 269/296; 248/201, 214, 231.9, 231.91, 242, 248/274.1, 288.11
See application file for complete search history.

(56) References Cited

U.S. PATENT DOCUMENTS

| | | | | | |
|---|---|---|---|---|---|
| 1,068,250 | A * | 7/1913 | Koenig | ..... | 248/201 |
| 1,090,687 | A * | 3/1914 | Coon | ..... | 248/242 |
| 1,102,480 | A * | 7/1914 | Davis | ..... | 248/242 |
| 1,185,525 | A * | 5/1916 | Morris | ..... | 211/104 |
| 1,253,924 | A * | 1/1918 | Barnett | ..... | 248/241 |
| 1,345,344 | A * | 7/1920 | Blandford | ..... | 248/242 |
| 2,195,579 | A * | 4/1940 | Murdock | ..... | 248/242 |
| 3,420,488 | A * | 1/1969 | Sisler | ..... | 248/291.1 |
| 3,433,443 | A * | 3/1969 | Mangan et al. | ..... | 248/214 |
| 4,128,234 | A | 12/1978 | McKee | | |
| 4,981,288 | A | 1/1991 | Gross | | |
| 5,203,393 | A | 4/1993 | Blevins et al. | | |
| D338,310 | S | 8/1993 | Clarke | | |
| 5,865,410 | A * | 2/1999 | Horen | ..... | 248/242 |
| 6,026,932 | A * | 2/2000 | Comp | ..... | 182/150 |
| 6,505,803 | B1 | 1/2003 | Hernandez | | |
| 6,508,448 | B1 | 1/2003 | Stewart | | |
| 7,779,568 | B2 * | 8/2010 | Gettelfinger et al. | ..... | 40/624 |
| 2006/0273702 | A1 | 12/2006 | Espindola et al. | | |
| 2009/0008849 | A1 | 1/2009 | Cunningham | | |

* cited by examiner

*Primary Examiner* — David B Thomas

(74) *Attorney, Agent, or Firm* — Laubscher & Laubscher, P.C.

(57) ABSTRACT

A cabinet installation system is characterized by the use of adjustable brackets and rails used to align a wall or base cabinet for mounting the cabinets on a wall. The brackets include horizontal and vertical legs which are connected via a hinge at one end and by an adjustable device at the other end so that the brackets have a triangular configuration. The adjustable device varies the angle between the legs so that when the vertical leg of a bracket is mounted on a wall, the horizontal leg can be adjusted to a level position. Front and rear rails are adjustably connected with the brackets. With the brackets arranged in spaced relation on a wall and the horizontal legs adjusted to level, the rails are adjusted relative to each bracket, respectively, so that the rails are linear, parallel and spaced according to the depth of the cabinet. When a cabinet is aligned relative to the rails, it can be secured to the wall in a straight and level position.

6 Claims, 3 Drawing Sheets

CABINET INSTALLATION ASSEMBLY

BACKGROUND OF THE INVENTION

The subject invention relates to built-in cabinets and more specifically to an assembly for the installation of wall and base cabinets.

There are two schools of thought as to where to start the installation of a set of wall and base cabinets. One procedure is to install the base cabinets first and the other is to install the wall cabinets first. Each procedure has its benefits. However, when the base cabinets are installed first, access to the wall cabinets is difficult because the base cabinets protrude from the face of the wall cabinets. Conversely, when wall cabinets are installed first there is nothing to hold them in place while they are leveled, plumbed and set to assure that the cabinet box is not racked or secured to an uneven wall leaving the box twisted. Two installers are generally needed to install wall cabinets so that one can hold the cabinet in place while the other fastens the cabinets to the wall.

BRIEF DESCRIPTION OF THE PRIOR ART

Various devices for supporting cabinets during mounting are known in the prior art as evidenced by the US patent to Goss No. U.S. Pat. No. 4,981,288 and the Cunningham US patent application publication No. 2009/0008849. These prior devices include brackets for supporting a wall cabinet while it is fastened to the wall, with the Goss device being adjustable. While these prior devices operate satisfactorily, they are rather cumbersome and do not provide both level and depth alignment of a cabinet relative to a wall that is not square or even.

The present invention was developed in order to overcome these and other drawbacks of the prior cabinet mounting assemblies by providing a mounting assembly that can support and align a cabinet and that allows a cabinet to be mounted with only one installer.

SUMMARY OF THE INVENTION

Accordingly, it is a primary object of the invention to provide a cabinet installation assembly including a plurality of brackets each of which includes horizontal and vertical legs which are hinged at one end so that the angular relation of the legs can be adjusted relative to each other. An adjustment device is connected between the other ends of the legs, so that the brackets have a generally triangular configuration. The adjustment mechanism displaced the horizontal leg relative to the vertical leg to vary the angle between the legs. Front and rear rails are connected with the horizontal leg. More particularly, the horizontal leg contains a spaced pair of slots adjacent to the ends of the leg. Fasteners are provided which pass through the slots and engage threaded openings in the rails so that the rails can be arranged at fixed locations relative to a wall on which the vertical legs of the brackets are mounted. The adjustment mechanisms are operable to level the horizontal legs and the rails are adjusted to a linear configuration to accommodate variations in the wall. A cabinet to be connected with the wall is aligned relative to the front and rear rails and then shimmed and fastened to the wall.

According to a further object of the invention, the adjustment mechanism comprises a turnbuckle assembly and the rails have two portions defining an L-shaped configuration. The threaded openings are provided in one portion of each rail and the other portion of each rail defines a flange with which the front and rear edges of the cabinet are aligned.

The horizontal and vertical legs preferably include angled portions at the end where the legs are connected with the hinge. The angled portions define a region for accommodating the flange of the rear rail for alignment with the rear edge of the cabinet.

BRIEF DESCRIPTION OF THE FIGURES

Other objects and advantages of the invention will become apparent from a study of the following description when viewed in the light of the accompanying drawing, in which.

DETAILED DESCRIPTION

Figure 1:
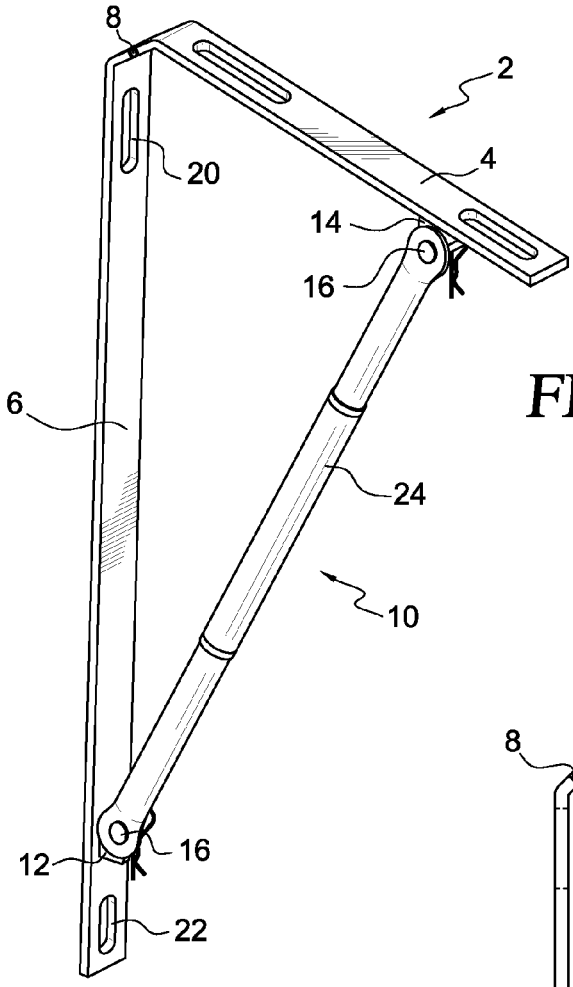
FIG. 1 is a perspective view of a mounting bracket of the cabinet installation assembly according to the invention.
Figure 2:
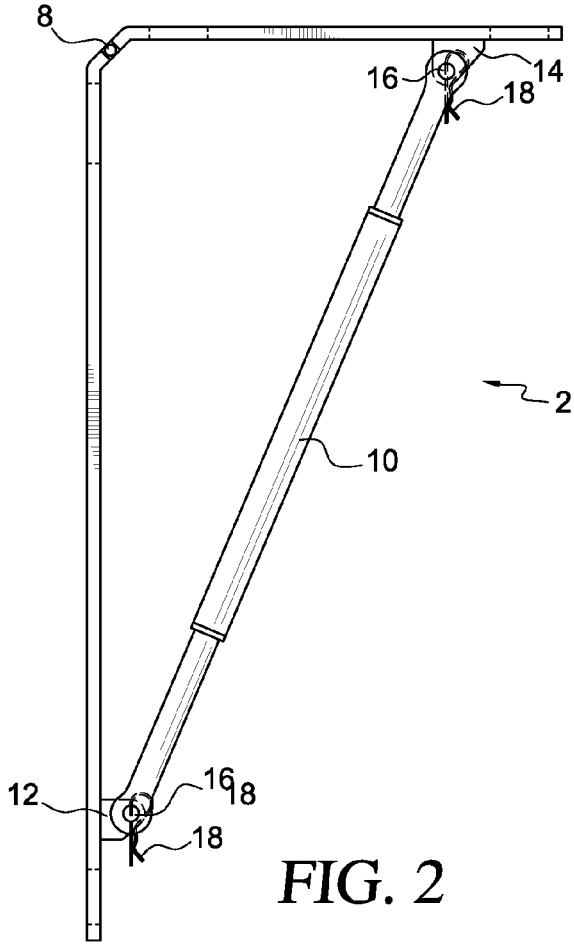
FIG. 2 is a side plan view of the mounting bracket of FIG. 1.
Figure 3:
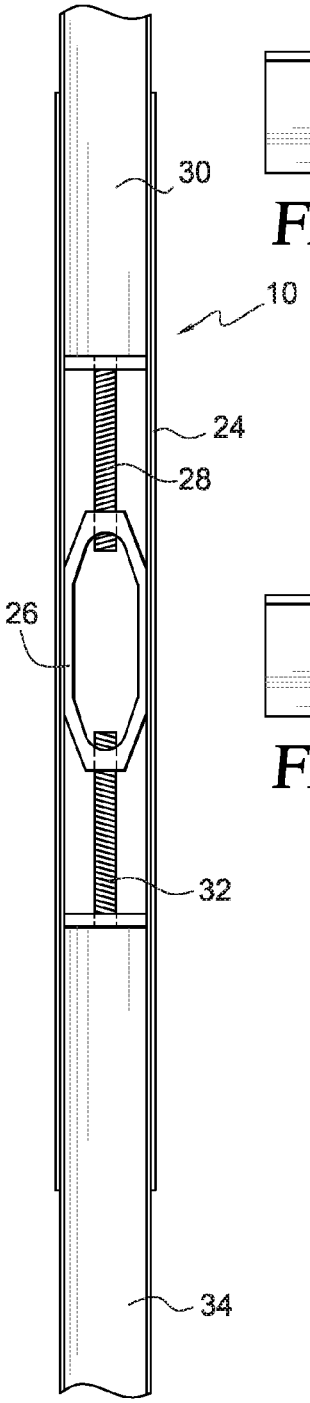
FIG. 3 is cut away view of the turnbuckle adjustment mechanism for the mounting bracket of FIG. 1.

The cabinet installation assembly according to the invention includes a plurality of adjustable brackets, one of which is shown in FIGS. 1-3. Each bracket 2 includes a horizontal leg 4 and a vertical leg 6 which are connected at one end via a hinge 8 so that the angle between the legs is adjustable. More particularly, an adjustment device 10 is connected between the other ends of the horizontal and vertical legs so that the bracket has a triangular configuration. The adjustment device 10 is preferably removably connected with the legs. Thus, the vertical leg includes a flange 12 containing an opening and the horizontal leg includes a flange 14 also containing an opening. A clevis pin 16 passes through openings in the ends of the adjustment device and the flanges to connect the ends of the adjustment device with the respective legs. A cotter pin 18 passes through the clevis pin to fasten it in place.

The vertical leg contains an upper slot 20 and a lower slot 22 for receiving a fastener such as a screw, not shown, to fasten the bracket to a wall by driving the screw into a stud of the wall. A plurality of brackets are mounted along the wall in spaced relation at the same height to assist with support and/or alignment of a cabinet or cabinets as will be developed in greater detail below.

Referring to FIGS. 2 and 3, the adjustment device contains a sleeve 24 having a turnbuckle 26 or other similar device allowing for left hand threads on one side and right hand threads on the other connected with an inner surface thereof. The turnbuckle or center of the adjustment arm is connected with an upper right hand threaded rod 28 secured to an upper portion 30 of the adjustment device and a lower left hand threaded rod 32 secured to a lower portion 34 of the adjustment device. Rotation of the sleeve by the user in one direction causes the turnbuckle to rotate which in turn displaces the threaded rods and the upper and lower portions of the adjustment device toward each other and rotation of the sleeve in the opposite direction displaces the threaded rods and the upper and lower portions of the adjustment device away from each other. Because the adjustment device is connected between the ends of the legs, the sleeve is operable to displace the ends of the legs toward and away from each other to vary the angle between the legs. With the vertical leg fastened to a wall, rotation of the sleeve 24 raises or lowers the end of the horizontal leg remote from the wall.

Figure 4:
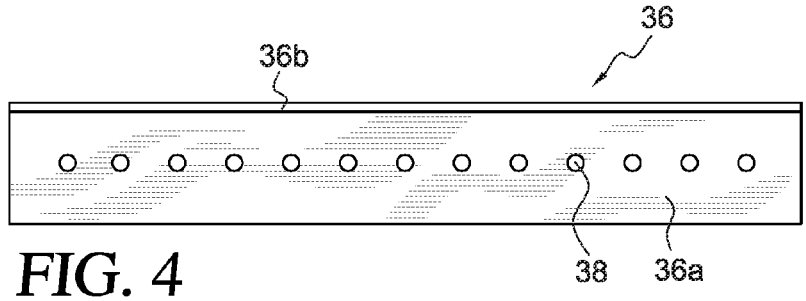
FIGS. 4 and 5 are top and side plan views, respectively, of a front rail of the cabinet installation assembly according to the invention.
Figure 5:
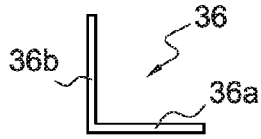
Figure 6:
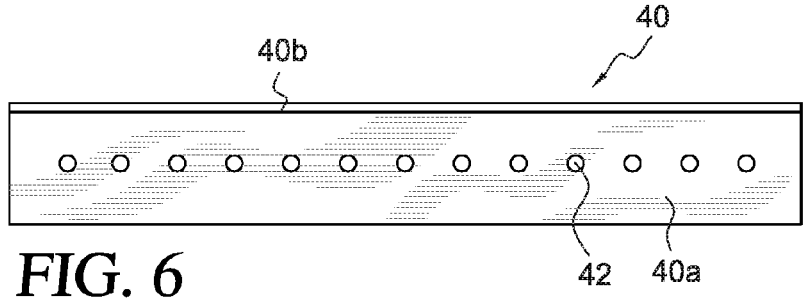
FIGS. 6 and 7 are top and side plan views, respectively, of a rear rail of the cabinet installation assembly according to the invention.
Figure 7:
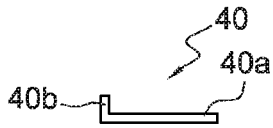
Figure 8:
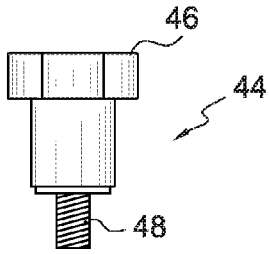
FIGS. 8 and 9 are front and top plan views, respectively, of a fastener of the cabinet installation assembly according to the invention.
Figure 9:
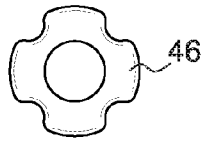

The cabinet installation system according to the invention further includes front and rear rails connected with the brackets. The front rail 36 is shown in FIGS. 4 and 5 and has an L-shaped configuration including a first portion 36*a* which contains a plurality of spaced threaded openings 38 and a second flange portion 36*b*. The flange portion is arranged generally normal to the first portion. The rear rail 40 is similar to the front rail in that it also has an L-shaped configuration with first and second portions 40*a* and 40*b* and threaded openings 42 in the first portion. The second or flange portion 40*b* is preferably shorter than the flange portion of the front rail. The rails are provided in suitable lengths such as six feet to extend across a plurality of brackets mounted on a wall. The rails are connected with the brackets using fasteners 44 shown in FIGS. 8 and 9. Each fastener includes a knob 46 and a threaded stem 48.

Referring back to FIG. 1, the horizontal leg 4 includes a first slot 50 adjacent to the end where the adjustment device is connected with the horizontal leg and a second slot 52 adjacent to the hinge 8. In order to connect the rails with the brackets, the fasteners pass through the slots and into a selected threaded hole in the respective rails. The elongated slots allow the fasteners be positioned laterally relative to the horizontal leg of each bracket. In this manner, the fasteners and thus the rails can be positioned relative to each bracket so that the rails are arranged in a linear fashion and parallel to each other, even though the wall to which the brackets are fastened may not be perfectly flat or square. Moreover, the rails can be spaced according to the depth of the cabinet being installed. Other adjustable fastening devices may be used for connecting the rails with the horizontal legs of each bracket.

Figure 10:
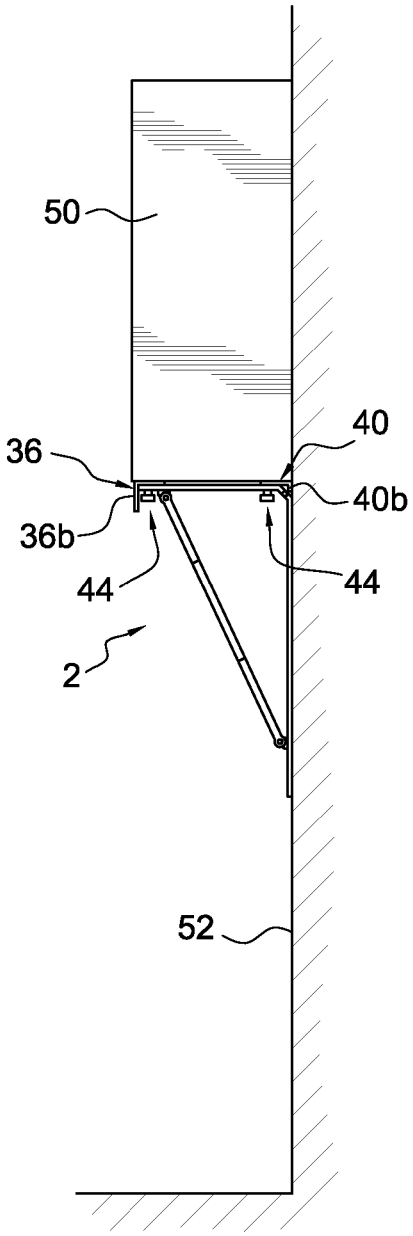
FIG. 10 is a side view of the cabinet installation assembly according to the invention used for mounting a wall cabinet.

Use of the cabinet installation system for mounting cabinets will be described with reference to FIGS. 10 and 11. In FIG. 10, the cabinet installation system is shown for mounting a wall cabinet 50. A plurality of brackets 2 (of which one is shown in FIG. 10) are mounted in parallel spaced relation on a wall 52. The front rail 36 is connected with the bracket via a front fastener 44 with the flange 36*b* extending downwardly. The rear rail 40 is connected with the bracket via a rear fastener 44 with the flange 40*b* extending downwardly into the void defined by the angled portions of the horizontal and vertical legs adjacent to the hinge. The brackets are adjusted by turning their tumbuckles so that the front and rear rails are level. The rails are adjusted relative to the slots in the horizontal legs of each bracket so that the rails are parallel and linear and spaced according to the depth of the cabinet. The cabinet is rested on the front and rear rails with the front edge of the cabinet aligned with the flange of the front rail. Shims are inserted between the cabinet and the wall and the cabinet is then secured to the wall studs in a conventional manner. The mounted cabinet is not twisted or curved in any manner and is also then plumb and level.

Figure 11:
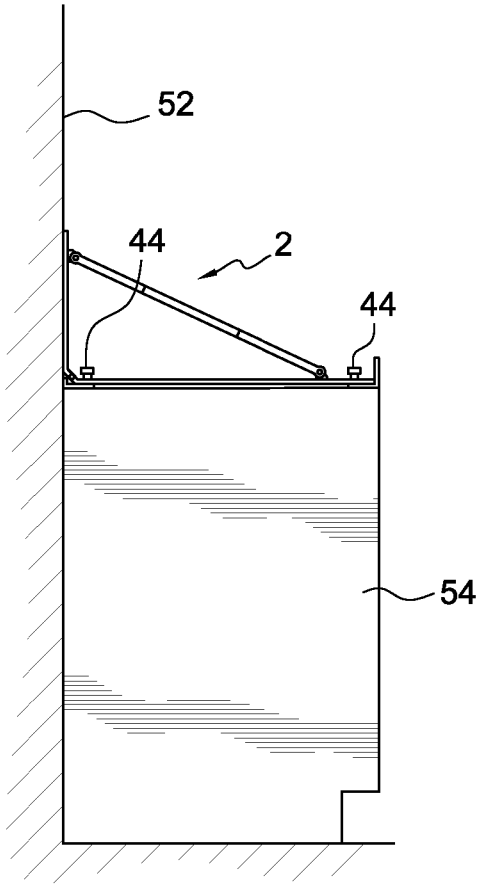
FIG. 11 is a side view of the cabinet installation assembly according to the invention used for mounting a base cabinet.

FIG. 11 shows the cabinet installation system for a base cabinet 54. A plurality of brackets 2 are mounted upside down relative to the brackets of FIG. 10. The rails are connected with the brackets using fasteners 44 and the rail flanges are directed upwardly. The brackets are adjusted so that the rails are level and the rails are adjusted relative to the horizontal legs so that the rails are parallel and linear and spaced according to the depth of the cabinet. The cabinet is shimmed at the rear and bottom so that its front and rear edges are aligned with the rail flanges. Once properly positioned, the cabinet is fastened to the wall 52, and preferably the wall studs, in a conventional manner.

The brackets and rails of the cabinet installation system can be formed of any rigid, durable material such as metal or synthetic plastic. In addition, when mounting a series of cabinets, spaces can be provided between cabinets to accommodate appliances, light fixtures, and the like.

While the preferred embodiment of the invention has been illustration and described, it will be apparent to those of ordinary skill in the art that various changes and modifications may be made without deviating from the inventive concepts set forth above.

What is claimed is:

1. A cabinet installation assembly, comprising (a) a plurality of brackets each of which includes generally horizontal and vertical legs connected at one end via a hinge and an adjustment mechanism connected between the horizontal and vertical legs at the other end, said adjustment mechanism being operable to displace said horizontal leg relative to said vertical leg about said hinge; and (b) a first rail adjustably connected with the horizontal legs of said brackets, said horizontal leg of each of said brackets containing a slot for receiving a fastener for adjustably connecting said first rail to said horizontal leg, whereby when said brackets are mounted in spaced parallel relation on a wall, said adjustment mechanism of each bracket may be operated to displace said horizontal leg of each bracket until said first rail is level and said first rail is adjusted relative to each horizontal leg until said first rail is linear, and further whereby a cabinet to be installed on the wall is aligned with an edge of said first rail to position the cabinet prior to fastening it to the wall.

2. A cabinet installation assembly as defined in claim 1, wherein said adjustment mechanism comprises a turnbuckle assembly.

3. A cabinet installation assembly as defined in claim 2, wherein said first and second rails contain a plurality of spaced parallel threaded openings for receiving said fastener.

4. A cabinet installation as defined in claim 3, wherein said first and second rails have two portions defining an L-shaped configuration, said threaded openings being arranged in one portion of said rails, the other portion defining a flange with which the edges of the cabinet are aligned.

5. A cabinet installation as defined in claim 4, wherein said one end of said horizontal and vertical legs include end portions angled toward said hinge, thereby to define a region for accommodating a flange of said second rail for alignment with the rear edge of the cabinet.

6. A cabinet installation assembly as defined in claim 1, and further comprising a second rail adjustably connected with the horizontal legs of said brackets in spaced relation to said first rail, said first and second rails being arranged at opposite ends of said horizontal legs for supporting a cabinet whose front edge is aligned with said first rail.

* * * * *